US008960076B2

(12) United States Patent
Epars et al.

(10) Patent No.: US 8,960,076 B2
(45) Date of Patent: Feb. 24, 2015

(54) CARTRIDGE FOR PREPARATION OF A LIQUID COMPRISING PUNCTURABLE DELIVERY WALL

(75) Inventors: Yann Epars, Penthalaz (CH); Antoine Ryser, Lausanne (CH); Vincent Martin, Crissier (CH); Conchita Tran, Gimel (CH)

(73) Assignee: Nestec S.A., Vevey (CH)

( * ) Notice: Subject to any disclaimer, the term of this patent is extended or adjusted under 35 U.S.C. 154(b) by 370 days.

(21) Appl. No.: 12/933,286

(22) PCT Filed: Mar. 16, 2009

(86) PCT No.: PCT/EP2009/053033
§ 371 (c)(1),
(2), (4) Date: Sep. 17, 2010

(87) PCT Pub. No.: WO2009/115475
PCT Pub. Date: Sep. 24, 2009

(65) Prior Publication Data

US 2011/0005399 A1 Jan. 13, 2011

(30) Foreign Application Priority Data

Mar. 18, 2008 (EP) ..... 08152871

(51) Int. Cl.
*A47J 31/06* (2006.01)
*B65D 85/804* (2006.01)

(52) U.S. Cl.
CPC ..... *B65D 85/8043* (2013.01)
USPC ..... 99/295

(58) Field of Classification Search
USPC ..... 426/77, 78, 112, 115, 431; 99/232, 282, 99/295, 297, 307, 323; 206/0.5
See application file for complete search history.

(56) References Cited

U.S. PATENT DOCUMENTS 5,242,702 A 9/1993 Ford
5,347,916 A 9/1994 Fond et al.
(Continued)

FOREIGN PATENT DOCUMENTS

EP 1555218 7/2005
EP 1580143 9/2005
(Continued)

OTHER PUBLICATIONS

WO 2005/092160, Suggi Liverani, Furio , Oct. 6, 2005.*
(Continued)

*Primary Examiner* — Dana Ross
*Assistant Examiner* — Joseph Iskra
(74) *Attorney, Agent, or Firm* — K&L Gates LLP

(57) ABSTRACT

A cartridge (1) containing a food substance adapted to interact with water injected in the cartridge to produce a food liquid comprising: a cup (2) having a chamber for holding the food substance (10) and a lid (7), a puncturable delivery wall (8) that holds the substance in the chamber, a puncturing structure (11) to puncture at least one opening in the delivery wall as a response of water filling the chamber, a collecting area (5) for collecting the liquid passing through the delivery wall in a substantially axial direction; said collecting area being placed downstream the puncturable delivery wall (8), at least one liquid outlet (15) in the collecting area for allowing the liquid to leave the collecting area, wherein the cartridge comprises a support structure (12) comprising at least one support surface (14, 17, 18, 19) configured to support at least one portion of the delivery wall to maintain a flow gap between the puncture structure (11) and the at least one outlet (15).

20 Claims, 8 Drawing Sheets

(56) References Cited

U.S. PATENT DOCUMENTS

| | | | | |
|---|---|---|---|---|
| 7,604,826 | B2 * | 10/2009 | Denisart et al. | 426/77 |
| 2005/0183581 | A1 * | 8/2005 | Kirschner et al. | 99/295 |
| 2006/0196364 | A1 * | 9/2006 | Kirschner | 99/295 |
| 2008/0156196 | A1 * | 7/2008 | Doglioni Majer | 99/295 |
| 2010/0282091 | A1 * | 11/2010 | Doleac et al. | 99/295 |

FOREIGN PATENT DOCUMENTS

| | | | |
|---|---|---|---|
| EP | 1 864 917 | | 12/2007 |
| WO | 03059778 | | 7/2003 |
| WO | 2005016094 | | 2/2005 |
| WO | WO2005020768 | | 3/2005 |
| WO | WO2005092160 | | 10/2005 |
| WO | 2006006112 | | 1/2006 |
| WO | WO2006006112 | | 1/2006 |
| WO | 2006/100570 | A1 | 9/2006 |
| WO | 2007039032 | | 4/2007 |

OTHER PUBLICATIONS

International Search Report—PCT/EP2009/053033—mailed Apr. 28, 2009—3 pages.

* cited by examiner

CARTRIDGE FOR PREPARATION OF A LIQUID COMPRISING PUNCTURABLE DELIVERY WALL

BACKGROUND

The present invention relates to a single-use cartridge containing an ingredient intended to interact with an amount of water injected in the cartridge for preparing a liquid. The cartridge is typically used for preparing liquid food such as a nutritional liquid preparation, e.g., an infant formula, a soup or a beverage. The cartridge is typically inserted in a dispensing machine adapted for receiving the cartridge, for injecting water at a suitable temperature and therefore preparing quickly, hygienically and conveniently a liquid food from said cartridge.

A cartridge for preparing liquid food in a dispensing machine, such as an in-home delivery system, is known for example in WO 03/059778. The cartridge comprises a cup forming a chamber for holding the food ingredient, a puncturable delivery wall such as a flexible membrane forming a physical barrier that retains the ingredient in the chamber, a puncturing system for puncturing the wall by effect of water filling the chamber under pressure. The cartridge further comprises a collecting area to collect the liquid which passes through the punctured membrane and at least one outlet for delivering the liquid from the collecting area.

For certain ingredients, it is important to allow a sufficient interaction between water and the ingredients in the cartridge, e.g., mixing, brewing or dilution, and to avoid water preferred flow path that could traverse the substance and leave dry portions of ingredients, e.g. food powder, which are not wetted by water. A delayed opening of the delivery wall of the ingredient's chamber of the cartridge ensures that the largest amount of ingredient is wetted before the liquid can leave the cartridge. This delayed opening provides a way to reduce the preferred flow shortcut through the substance. It also ensures a full dissolution of the substance when this one is soluble. Indeed, for certain ingredients, it is necessary to obtain a complete dissolution of the substance in the chamber before the liquid can be released. It means that opening must occur when the chamber is entirely filled and mixed with the ingredient and a liquid mixture is obtained. If the membrane opens too early, dry ingredient such as solid lumps may be left in the chamber. This may result in a volume of delivery food liquid that does not reach the required concentration. For certain liquid preparations such as infant formula or other nutritional preparations, a low concentration of the delivered liquid is not acceptable, in particular for persons for which the intake of food and nutrients must be accurately controlled.

Another problem met with existing cartridges is that the flow of the food liquid must be delivered in a controlled manner. In particular, the flow of liquid must not be blocked, reduced or restricted in some way. This is important for providing a rapid, consistent and hygienic delivery in particular with sensitive food such as infant formulas.

Also, for certain liquid preparations, a significant amount of foam on the delivered liquid may be not desired because it could provide a too high solid concentration of the final liquid and/or a texture which is not appropriate for its intended use.

Therefore, the flow of liquid must be delivered in a controlled manner, preferably without risk of blocking, without splashing, therefore, preferably smoothly through the delivery outlet, while still an effective mixing or homogenization can take place in the chamber of the cartridge. This may be contradictory with the need for a certain opening delay in the cartridge to obtain sufficient interaction between water and the substance in the cartridge. Indeed, a delayed opening requires creating a rise of pressure in the chamber till the chamber is opened. When the chamber opens, e.g., the delivery membrane ruptures, the liquid tends to flow as powerful jets through the created openings. In particular, the membrane tends to collapse forming restriction areas which are prone to form high velocity jets in many possible uncontrolled directions.

Therefore, existing cartridges are not properly designed to provide both a delayed opening allowing a proper interaction between water and the substance, e.g., a proper dissolution or brewing of the ingredient in the cartridge, and a slow and directionally controlled delivery flow that enables a hygienic delivery, such as a direct delivery in the receiving receptacle, i.e., a baby bottle, a cup or glass, with a reduced risk of contamination outside of the receptacle.

WO2005/016094 relates to a coffee or tea pod comprising a spiked pod into which is positioned a lower filter layer and a foiled envelope. The water pressure forces both the lower filter layer and the foiled envelope against the spikes of the spiked pod. The punctures caused by the spikes allow the brewed beverage to pass therethrough while substantially maintaining the brewing material therein. The beverage leaves the pod through a plurality of holes distributed in the bottom of the pod.

EP1555218B1 relates to a cartridge for coffee or a soluble substance comprising a container, a lid and a filter designed to be positioned inside the container and above the bottom wall through which the beverage leaves. The bottom wall has a breakable portion designed to break when the liquid inside the cartridge reaches a pre-set pressure so as to form an aperture to allow beverage to be extracted from the cartridge. The breakable portion is obtained by means of grooves formed in a weakened portion of the bottom wall. One problem is that it is relatively difficult to control the resistance of the weakened portion that opens under the sole effect of the pressure of fluid in the cartridge to ensure a reproducible delay of the opening time from cartridge to cartridge. Thus, inconsistent opening times will cause beverages having different solids concentration and thus different quality.

EP1580143B1 relates to a cartridge for extracting a beverage from particulate substance contained therein by means of water under pressure, the cartridge comprising a cup portion with a cup port and a lid for closing the cup portion; the base of the cup portion comprising a plurality of ridges directly formed thereon and protruding towards the internal volume of the cartridge and a filter placed on the ridges to define a fine canalization between the filtering means and the cup port. The delayed opening is obtained by means of a slit or orifice valve that opens under an internal pre-set pressure. The filter must be sufficiently thick and rigid enough to resist the pressure and avoid its collapsing in the canalization. A disadvantage is the use of thick plastic material to resist the pressure and the high number of pieces necessary to form the cartridge which makes the cartridge complex and costly to manufacture.

WO2007/039032 relates to a cartridge of the same principle as the one of EP1580143B1 but with a safety cap which is mounted on the external surface of the cup port and partially closes the external open end thereof.

SUMMARY

The present invention aims at improving a cartridge for solving the above-mentioned problems and possibly others. In a general manner, the cartridge of the invention aims at improving the consistency of the flow of the liquid that exits the cartridge and at improving the dissolution or brewing of the substance contained in the cartridge.

The cartridge of the invention contains a food substance adapted to interact with water injected in the cartridge to produce a food liquid that is dispensed from the cartridge.

The cartridge comprises:

a cup having a chamber for holding the food substance and a lid, a puncturable delivery wall that holds the substance in the chamber, a puncturing structure to puncture at least one opening in the delivery wall as a response of water filling the chamber, a collecting area for collecting the liquid passing through the delivery wall; said collecting area being placed downstream the puncturable delivery wall, at least one liquid outlet in the collecting area for allowing the liquid to leave the collecting area, wherein the cartridge comprises a support structure comprising at least one support surface configured to support at least one portion of the delivery wall to maintain a flow gap between the puncture structure and the at least one outlet.

Preferably, at least one support surface is arranged in the flow path between the puncturing structure and the at least one outlet and/or is placed above and/or adjacent the at least one outlet.

Therefore, the cartridge of the invention prevents the membrane from collapsing in the collecting area or from forming blocking areas for the flow and therefore, the cartridge ensures a more regular flow path and a controlled direction of the liquid flow path downstream of the punctured membrane. The flow path may also be controlled to change direction in such a way that it can slow down sufficiently and can be released in a smoother way.

In a mode, the support structure is placed between the puncturable delivery wall and the bottom wall of the cup forming the collecting area.

The support structure is preferably connected to the bottom wall of the cup. It can be integral to the bottom wall and extending therefrom.

The puncturing structure is also preferably connected to the bottom wall, most preferably, this structure is an integral part of the bottom wall of the cartridge.

In order to provide a more homogeneous flow of the liquid delivered out of the cartridge, the cartridge can comprise a series of outlets. The outlets are preferably placed or gathered in or closed to the centre of the collecting area. The number of outlets may vary. For instance, the number of outlets may be between 1 and 10. The outlet can also be a flow guiding duct extending from the outlet(s). The outlets may be placed circumferentially around the guiding duct to collect the liquid flowing transversally from the collecting area.

In particular, at least one support surface of the support structure forms a portion of disc or a dome that extends transversally beyond the outlet or the series of outlets. The small portion of disc or dome is preferably larger than or substantially equal to the largest transversal dimension of the outlet or the series of outlets. As a result, the delivery wall can be properly supported by the support structure and there is a lower risk that outlets become blocked by a flexible collapsing wall, e.g., a membrane, due to the pressure of liquid in the cartridge. The outlet(s) can so be maintained with a defined opening surface area, with a reduced risk of possible restriction formed by a deformed part of the delivery wall. The liquid outlet(s) is (are) thus neither blocked nor restricted by the delivery wall. The portion of disc preferentially may be a flat or slightly convex upper surface to support the delivery wall without risk of rupture of it.

According to an aspect of the invention, the support structure comprises portions of ridges placed in the flow path between the puncturing means and the at least one outlet. The portions of ridges are placed concentrically around the liquid outlet(s), with flow passages in-between, for breaking the flow of liquid towards the outlet. The portion of ridges may take different forms and dimensions. The portions of ridges provide support but also may break the flow of liquid towards the outlet(s).

For example, the portions of ridges can radially surround the outlet, and be placed at a radial distance from the outlet. Hence, the portions of ridges form a concentric discontinuous pattern to provide the flow with a tortuous slowing down path toward the outlet. For this, the portions of ridges delimit a series of circumferential channels and of radial passages between the ridges for the liquid to be slowed down and guided toward the outlet(s).

The puncturing structure may form a plurality of small protrusions. The protrusions have a sufficiently sharp edge or tip to perforate the puncturable wall when the wall is pressed thereon by the effect of the pressure that builds in the cartridge. Hence, the puncture structure may comprise puncture surfaces of smaller width or section than the width or section of the support surface of support structure. Therefore, the puncturable wall will resist to perforation on the support structure thus creating suitable gaps for flow path toward the outlets whereas it will perforate by relatively defined openings against the protrusions of the puncturing structure.

The protrusions can be arranged concentrically around the outlet(s). Therefore, different streams of liquid flow are created through the delivery wall of the chamber to ensure also a proper circulation of water through the substance in the chamber as well as a homogeneous flow of liquid which collects in the collecting area.

The protrusions of the puncturing structure may be formed of a plurality of a sharp puncturing forms like crosses, cones or blades. In a preferred configuration, the protrusions form crosses in their transversal section.

The support structure further comprises portions of ridges placed in a radial direction of the bottom surface of the cup. The radially oriented portions of ridge can provide an additional support of the delivery wall, in particular, when placed between the protrusions. Therefore, the wall is prevented from collapsing between the protrusions. Hence, the liquid is better guided in the collecting areas.

According to a preferred example, the cup is an injected plastic member such as in polypropylene or any other suitable food grade plastic material. The delivery wall is preferably a flexible membrane made of aluminium and/or polymer. The delivery wall can be sealed on an inner annular step portion provided in the cup. The delivery wall can remain unsealed onto the support structure as the pressure. The cup is further sealed by a puncturable membrane forming the lid of the cartridge.

In a mode, the lid of the cartridge comprises at least one injection orifice of small size for forming a jet of the liquid entering the chamber containing the food substance. The at least one injection orifice has preferably a diameter of less than 1.0 mm, most preferably comprised between 0.4 and 0.8 mm. Such small sizes of the orifice generate high momentum of the liquid in the cartridge and therefore enhance the dissolution or dispersion of the substance, in particular, fat and protein powder. The at least one injection orifice is preferably placed in a location which is not axially aligned, i.e., off-centred, relative to the centreline of the cartridge. In a mode, the number of orifices is low, preferably, less than 5, most preferably one or two orifices are formed in the lid.

The lid can further comprise a protective cover placed externally of an under-layer of the lid comprising the jet-forming orifice(s), for ensuring protection of the substance contained in the chamber before use of the cartridge. Such protective cover can be a peel-off or a puncturable membrane for instance.

In a first mode, the injection orifice is configured to orient a jet of liquid in a direction which is substantially normal to the puncturable delivery wall. In the terms "substantially normal direction", it is meant that the configuration of the jet of liquid is not of more than 10 degrees from the normal to the delivery wall.

In another possible mode, the injection orifice is configured to orient a jet towards the support surface of the support structure configured to support the delivery wall.

In another aspect of the invention, a cartridge system is proposed which comprises:

a cartridge and a beverage production device for holding said cartridge and comprising a water injection intruding member.

The water injection intruding member of the device is designed to inject water in the cartridge under pressure for interacting with a food to produce a food liquid that is dispensed from the cartridge. The cartridge comprises a cup having a chamber for holding the food substance, a lid and a delivery wall puncturable by the water injection intruding member that holds the substance in the chamber, a puncturing structure to puncture at least one opening in the delivery wall as a response of water filling the chamber, a collecting area for collecting the liquid passing through the delivery wall in a substantially axial direction. The collecting is placed downstream the puncturable delivery wall. At least one liquid outlet in the collecting area for allowing the liquid to leave the collecting area. The cartridge comprises a support structure comprising at least one support surface configured to support at least one portion of the delivery wall and wherein the water injection intruding member is configured to inject water in the cartridge under pressure in a direction focused towards said support surface.

Such a configuration of the water injecting means relative to the cartridge ensures that the delivery wall is not pierced accidentally at a non-desired point and it also provides an improved mixing of water in the chamber of the cartridge by promoting reflections of the water jet in the chamber. In particular, the water injection intruding member is so arranged that the water jet hits the delivery wall which is supported by the membrane. Therefore, since the wall is supported by the support surface underneath, the water jet does not perforate the wall due to the localized water pressure on the wall, e.g., an aluminium or plastic membrane. The water jet is further diverted in the direction of the chamber and can create a vortex in the chamber that promotes an improved interaction between water and the substance, e.g., a good mixing.

The delivery wall can be a puncturable membrane that is gastight for opening under pressure against the puncture structure, such as an aluminium membrane or a non-porous polymer such as PP.

Alternatively the delivery wall can be a filter such as a paper filter or a porous filter membrane. The filter is supported by the support structure for resisting to the pressure in the chamber without tearing and/or collapsing and closing the flow gap in the collecting area. The delivery wall can be formed by the superposition of both a puncturable non-porous membrane and a filter.

In a first possible mode, the water injection intruding member has a piercing tip for being able to perforate the lid. The member has a water outlet which is arranged to direct at least one jet of water in the direction towards the support surface of the cartridge. Preferably, the direction is towards the centre of the cartridge. The water outlet may be designed to provide a fan spray of waterforming a cone which centreline is directed towards the support surface.

The water injection intruding member can be located in an off-centred location relative to the centre of the cartridge. The water injection intruding member can also be aligned axially in the centre of the cartridge. More than one water injection intruding members can enter the cartridge at different locations.

In one mode, the cartridge has a support surface which is transversally oriented to the longitudinal axis of the cartridge and the water injection intruding member is off-centred relative to said axis.

In another mode, the cartridge has a support surface which is transversally oriented to the longitudinal axis of the cartridge and the water injection intruding member is aligned with said axis.

In another aspect, the invention relates to a cartridge system comprising:

a cartridge and a beverage production device for holding said cartridge and, water injection means; wherein the cartridge contains a food substance adapted to interact with water injected through the water injection means in the cartridge and to produce a food liquid that is dispensed from the cartridge;

said cartridge comprising:

a cup having a chamber for holding the food substance and a lid, a delivery wall that holds the substance in the chamber, a puncturing structure to puncture at least one opening in the delivery wall as a response of water filling the chamber, a collecting area for collecting the liquid passing through the delivery wall in a substantially axial direction; said collecting area being placed downstream the puncturable delivery wall, at least one liquid outlet in the collecting area for allowing the liquid to leave the collecting area, wherein the cartridge comprises a support structure comprising at least one support surface configured to support at least one portion of the delivery wall and wherein the water injection means are configured to inject water in the chamber under pressure in the form of at least one jet.

In a first possible mode, the water injection means comprises a water injection intruding member of the beverage production device as aforementioned.

In an alternative mode, the water injection means comprises a lid of the cartridge comprising at least one small orifice configured to form a high-momentum jet of liquid (i.e., water) in the chamber as aforementioned. The jet-forming orifices can be oriented in a direction normal to the puncturable delivery wall of the cartridge or alternatively be inclined towards the support surface of the support structure.

Further features of the present invention will be described in more detail in the following description in which:

DETAILED DESCRIPTION

Figure 1:
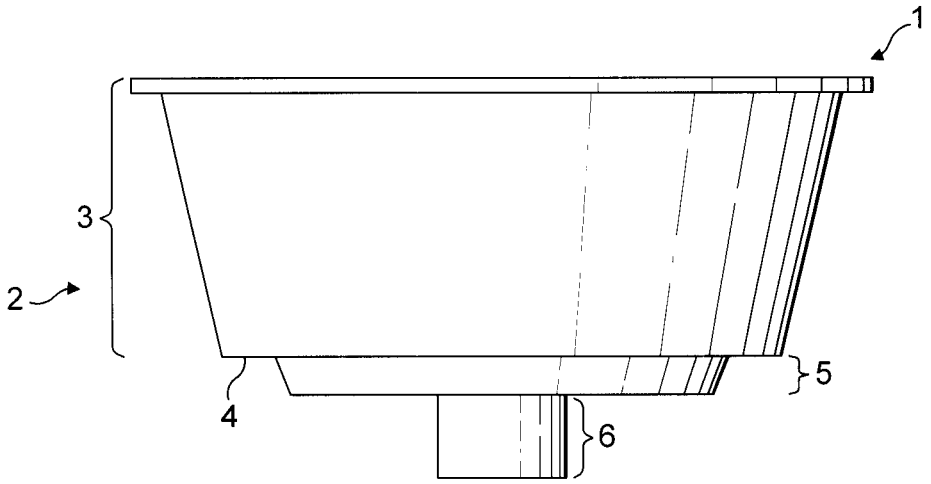
FIG. 1 is a side view of a cartridge of the invention according to a first embodiment.
Figure 2:
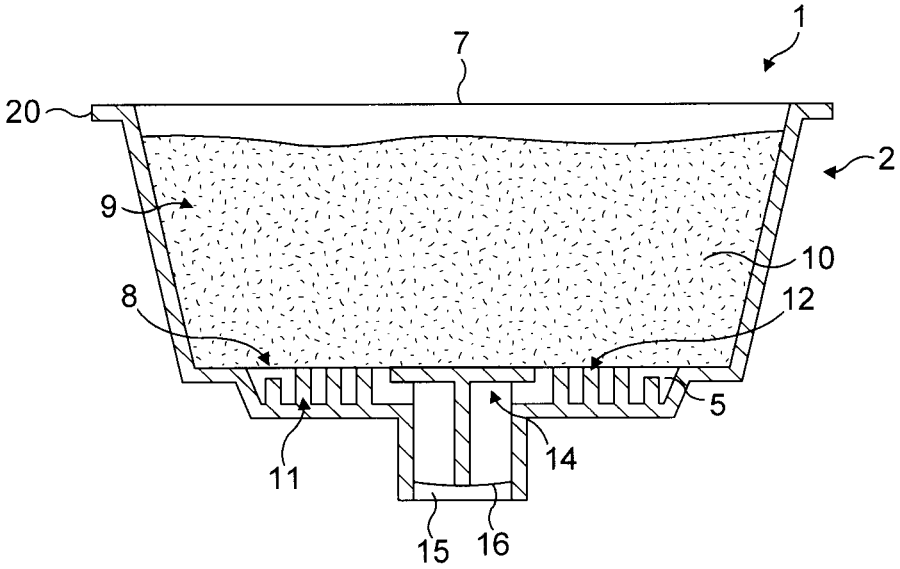
FIG. 2 is a cross sectional view of the cartridge of FIG. 1.

A cartridge of the present invention in a first mode is illustrated in FIGS. 1 to 7. The cartridge 1 comprises a cup 2 preferably made of plastics. Suitable thermoplastics can be polypropylene or a multi-layer of polypropylene layers and a gas barrier layer such as EVOH. A possible multi-layer can be PP-EVOH-PP. The cup is preferably obtained by injection in one piece. The cup comprises a main body portion 3, a stepped portion 4 and collection area 5 and a tubular outlet portion 6.

At the upper end of the cartridge, an upper side edge 20 protrudes outwards forming a sealing area for a lid 7. The lid 7 can be a flexible membrane which forms the water injection side of the cartridge. Injection of water is typically performed by piercing the membrane at one or several points in the membrane by means of a perforating system of a beverage preparation machine (not shown). The membrane can be typically made of a thin laminate of aluminium and/or polymers. For instance, the membrane comprises a laminate of PET and a gas barrier layer such as EVOH.

In an alternative, the membrane lid 7 may be peelable and so removed before insertion in the food preparation machine. In this case, the machine may be designed to cover in a water-tight arrangement the upper side of the cartridge by an injection shower applying a fluid-tight pressure on the upper edge 20 of the cup. In another alternative (not shown), the lid is a thicker wall comprising premade injection openings for distributing water in the cartridge.

Inside the cup of the cartridge is placed a flexible puncturable delivery wall 8, e.g., a second membrane. The membrane can be welded onto a peripheral internal edge 42 of the cup. The first and second membranes 7, 8 therefore delimit together with the body portion of the cup, a closed chamber 9 that contains a food substance 10, e.g., a dose of soluble nutritional ingredients. The chamber can be gastight, substantially oxygen free and be filled by a protective gas such as nitrogen in order to protect the substance 10. For example, the membranes can be made of a material such as aluminium for which the puncture resistance can be precisely controlled and which also provides a suitable tightness to gas. For example, the internal membrane 8 can be made of thin aluminium, for example, of between 10 and 100 microns. The volume for the chamber 9 may vary depending on the type of ingredient and the liquid food to be delivered. For instance, the volume may vary from 25 to 100 cc, preferably between 30 to 70 cc.

At the bottom of the cup 2 is placed a membrane puncturing structure 11. The membrane puncturing structure is designed to puncture a plurality of perforations in the membrane when a threshold of pressure inside the chamber is reached as water fills the chamber. According to an aspect of the invention, the membrane puncturing system 11 is designed to enable a delayed opening of the flexible delivery wall 8, i.e., puncturing of the membrane, so that the chamber has the time to be entirely filled with water and dissolution of the ingredient is carried out entirely in the chamber with as little solid, preferably no solid, as possible left in the chamber. The puncturing structure is associated to a support or distancing structure 12 which role is to maintain a flow path gap in the liquid collecting area and to avoid collapsing of the membrane when the membrane is punctured. The support structure is placed transversally or radially between the outlet and the puncturing structure.

Figure 3:
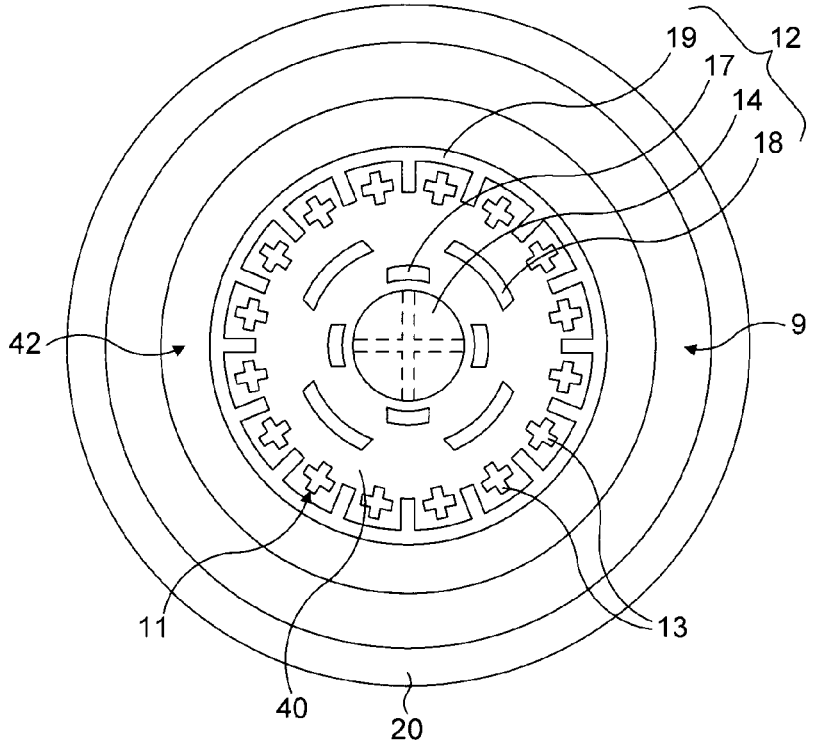
FIG. 3 is a top view of the cup of the cartridge of FIGS. 1 and 2.
Figure 4:
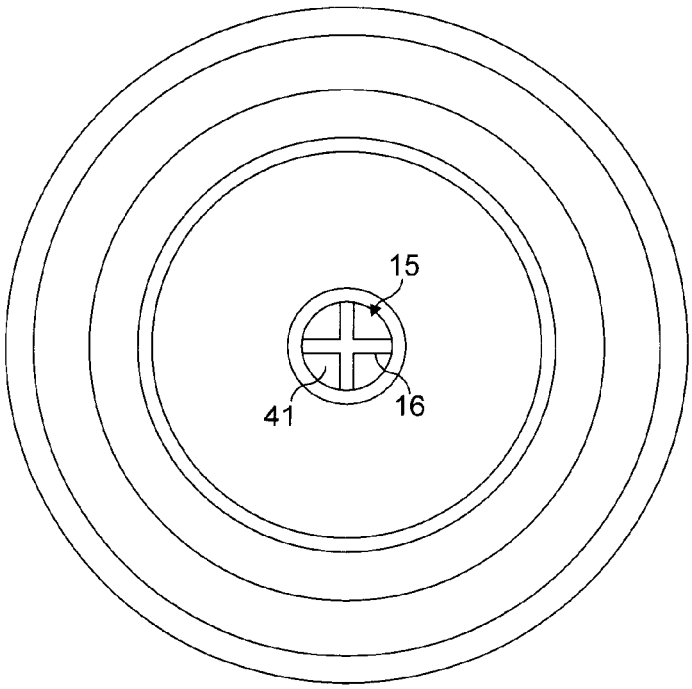
FIG. 4 is a bottom view of the cup of cartridge of FIGS. 1 and 2.
Figure 5:
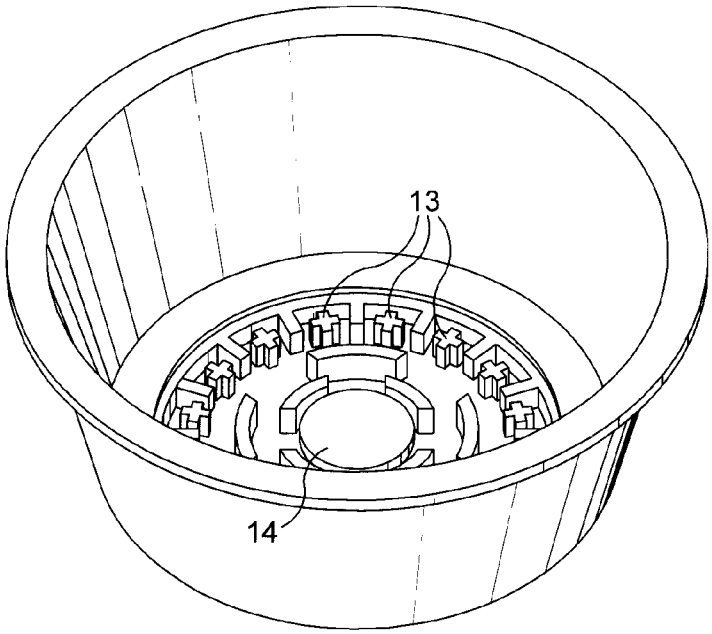
FIG. 5 is an upper perspective view of the cup of the cartridge of FIGS. 1 and 2.

In FIGS. 3 and 4 are shown a possible design of the puncturing and support structures. First of all, the puncturing structure comprises puncturing elements 13 in the form of cross-shaped protrusions which are located in the bottom wall 40 of the collecting area. The elements 13 are preferably made integral with the bottom wall 40. The membrane 8 ruptures when it is pressed, under the effect of the internal pressure in the chamber 9, onto the edges of a cross-shaped protrusions of the puncturing structure. The cross-shaped protrusions are used to tear the membrane and create a plurality of small perforations. The perforations as obtained by the circular distribution of the protrusions 13 are thus preferably created in a substantially circular pattern around and at a certain distance of the outlet.

Instead of cross-shaped protrusions, sharp puncturing forms like cones or blades, could be used to provide smaller or more defined perforations in the membrane. The number of these puncturing protrusions may vary from 5 to 20, for example. These protrusions have mainly a perforating role for the membrane that is pressed against.

Secondly, a support structure 12 is provided that comprises a central shield wall 14 having the form of a disc that covers the liquid outlet 15. This shield wall extends transversally to form a support for the membrane that deforms in the axial direction due to the pressure of liquid in the chamber. The shield wall is connected to the bottom surface of the collecting area by legs 16 delimiting in-between passages or openings 41 for the liquid to flow in the outlet 15.

The support structure 12 may comprise additional elements in relief such as small portions of ridges 17, 18, 19. These portions of ridges have a height that is substantially equal or slightly lower than the puncturing protrusions 13. In particular, portions of ridges 19 may be placed relatively close to the puncture structure but may be slightly smaller to enable a proper puncturing of the membrane by the puncturing structure. For instance, these portions of ridges 19 may be formed by a continuous circular ridge from which small portions of ridges extend radially to separate each cross-shaped elements 13. These portions ensure that the membrane does not collapse between each of the protrusions 13 and therefore ensure a homogeneous collection of the flow through the created perforations in the membrane. On the contrary, between the outlet and the puncturing protrusions, higher portions of ridges 17, 18 can be provided to support the membrane. These portions of ridges 17, 18 thus support the membrane and avoid the membrane to collapse in the gap between the puncture protrusions and the outlet. These second portions of ridge are thus placed in the radial flow path and also serve the function of dampening the liquid flow before it reaches the outlet.

Figure 6:
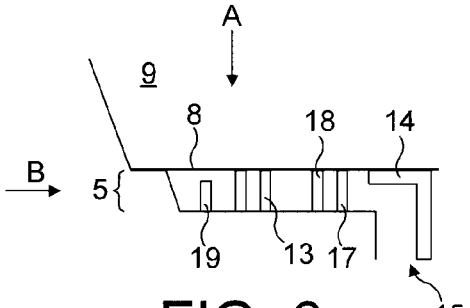
FIG. 6 is a schematic view showing a detail of the cartridge for the embodiments of FIGS. 1 to 4 before puncturing of the membrane.
Figure 7:
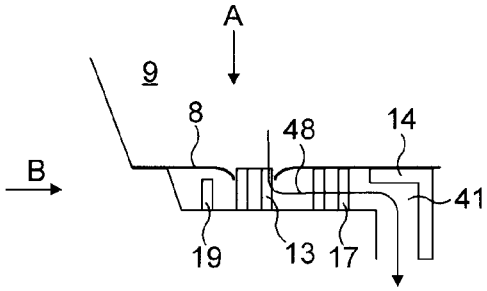
FIG. 7 is a schematic view similar to FIG. 6 after puncturing of the membrane.
Figure 8:
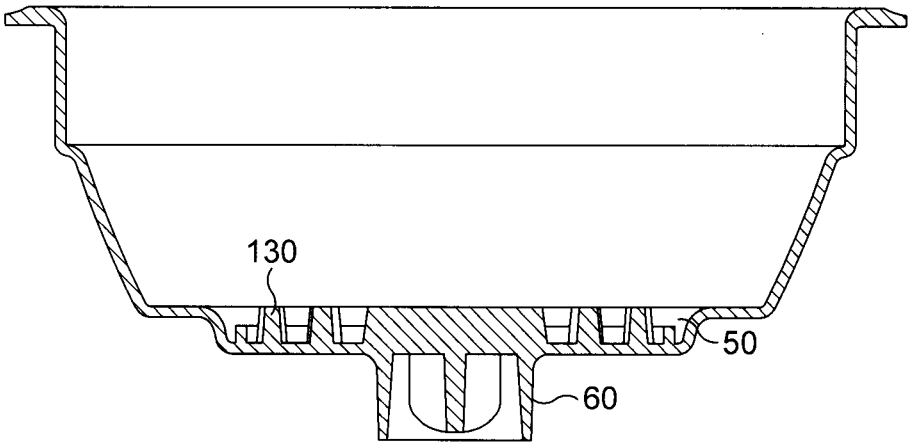
FIG. 8 is a cross sectional view of the cartridge of FIG. 1 according to a second embodiment.
Figure 9:
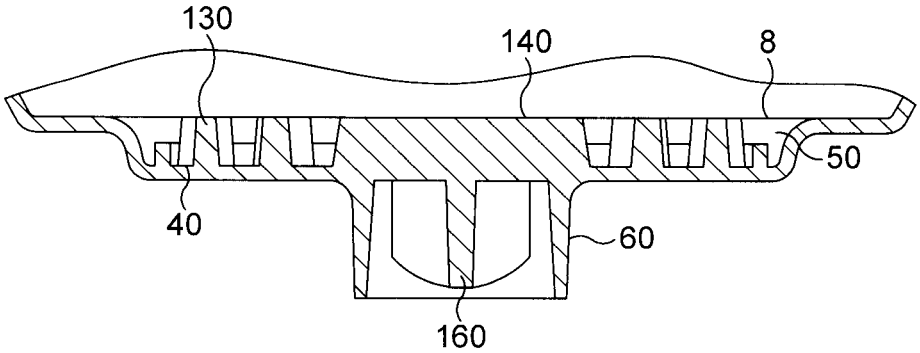
FIG. 9 is a detail of the view of FIG. 8.
Figure 10:
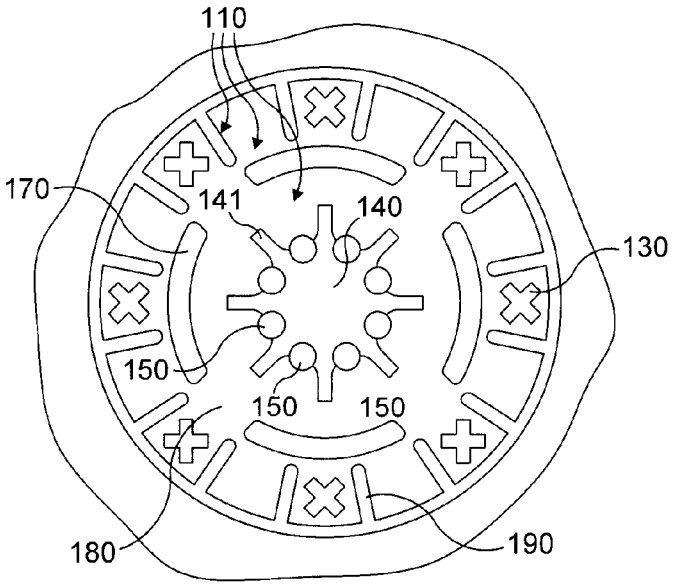
FIG. 10 is a top view of the cup of the cartridge of FIGS. 8 and 9.
Figure 11:
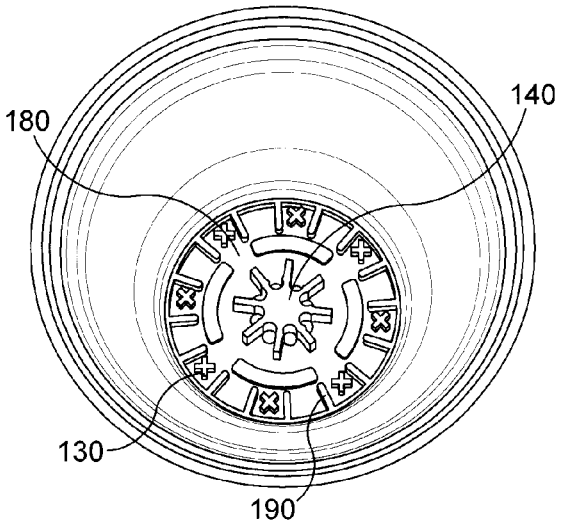
FIG. 11 is an upper perspective view of the cup of the cartridge according to the second embodiment.
Figure 12:
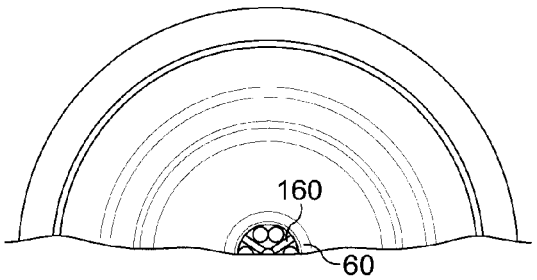
FIG. 12 is a bottom view of the cup of the cartridge according to the second embodiment.

FIGS. 6 and 7 explain the principle of the pressure-responsive opening of the cartridge and the liquid flow in the cartridge of the invention after opening of the membrane. In FIG. 6, the membrane 8 of the cartridge is intact and the internal pressure in the chamber 9 is insufficient to puncture the membrane 8 against the puncturing protrusions 13. As internal pressure builds up in the chamber the membrane starts deforming against the protrusions 13 of the puncture structure. Water needs to fill the chamber 9 entirely to create an overpressure sufficient to press the membrane against the protrusions until the tensile strength of the material of the membrane is reached. Hence, the protrusions can be designed that breaking of the membrane on these protrusions is controlled after the food ingredients have sufficiently dissolved or dispersed in water. For instance, breaking of the membrane may occur at about 2.5 bars of pressure in the chamber. The membrane may be an aluminium or a plastic membrane such as thin polypropylene.

FIG. 7 shows the membrane 8 being punctured against the protrusions 13. It is apparent also that the membrane remains supported on the support structure, in particular, by the portions of ridges 17 and the central shield disc 14. As the membrane is punctured, openings are created between the torn surface of the membrane and the surface of the puncturing protrusions. The crossed shaped section of the puncturing protrusions promotes draining of the liquid along the surface of the protrusions. Therefore, the liquid enters the collecting area 5 in a substantially axial direction (as illustrated by direction "A") across the membrane and in as many passages as perforations have created in the membrane. The liquid then transversally flows through the collected area up to the outlet 15 in the radial direction (as illustrated by direction "B"). Thanks to the flow path gap 48 which is maintained in the collecting area, the liquid is not solicited to form jets but on the contrary is dampened by the support or distancing structure 12 which is positioned between the openings created in the membrane by the puncturing protrusions and the central outlet in the collecting area. In particular, as a result of the concentric distribution of the portions of ridges 17, 18, placed at a certain distance around the outlet, the liquid is given a tortuous path through the collecting area thereby liquid velocity is significantly lowered. Liquid is then passed through predefined openings 41 provided in the outlet where it can thus be guided transversally through the tubular portion 6. The legs 16 in the outlet further provide dampening of the flow by offering a physical barrier transversal to the direction B of the flow in the collecting area and by splitting the liquid flow into different streams in the tubular portion. The tubular portion 6 extends in an axial direction causing again the liquid to slow down before it is dispensed in a receptacle. In the tubular portion can be placed a means for guiding the flow such as transverse ribs 16.

A second possible embodiment of the cartridge of the invention is illustrated in relation to FIGS. 8 to 12.

The difference with the previous embodiment essentially lies in the particular configuration of the support structure 110 in the centre of the collecting area 50. In particular, the support structure comprises a central support surface 140 placed adjacent to a series of outlets 150. The outlets 150 are provided in the bottom 40 of the cup. They can be positioned along a substantially circular pattern around the centre of the collecting area. For example, eight small outlets are provided. The support surface 140 is placed at a distance above the entry side of the outlets. The surface 140 further preferably extends outwardly by small legs 141 beyond the surface area of each outlet. Such a configuration ensures that the puncturable wall, e.g., delivery membrane 8, is correctly supported and does not break or collapse under pressure to block any of the outlets 150 in the central area. The outlets extend through the bottom of the cup outwardly to a tubular portion 60 for properly guiding the flow of liquid in a privileged direction. Inside the tubular portion 60 can be provided separating walls 160, for example, forming a crossed design in the plane of extension of the transversal section of the tubular portion.

In the collecting area 50, the puncture structure can be made by a series of protrusions 130, e.g., of cross-shaped section, distributed in the vicinity of the periphery of the bottom wall. The number of protrusions may be lower than for the preceding mode. For instance, the number of protrusion can be substantially equal to the number of outlets. Furthermore, the support structure can comprise curved portions of ridges 170. They may be arranged in a substantially discontinuous circular or concentric pattern with radial passages 180 formed between the portions of ridges. For example, the portions of ridges can be placed between the protrusions 130 and the outlets 150 to slow the liquid down in the collecting area. Additional portions of ridges 190 can be provided in radial direction relative to the centre of the collecting area and between the protrusions for a more precise tearing of the membrane on the puncture protrusions 130.

Figure 13:
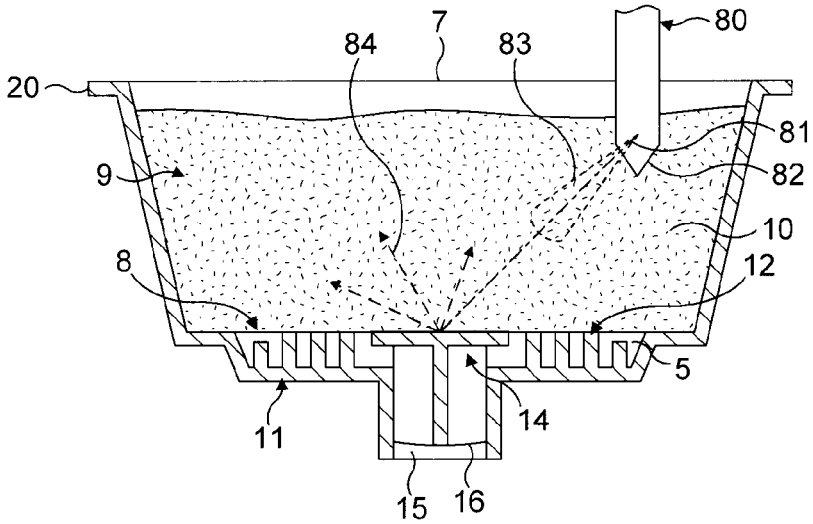
FIG. 13 is a cross sectional view of the cartridge of FIG. 2 associated to a water injection device of a beverage preparation device.
Figure 14:
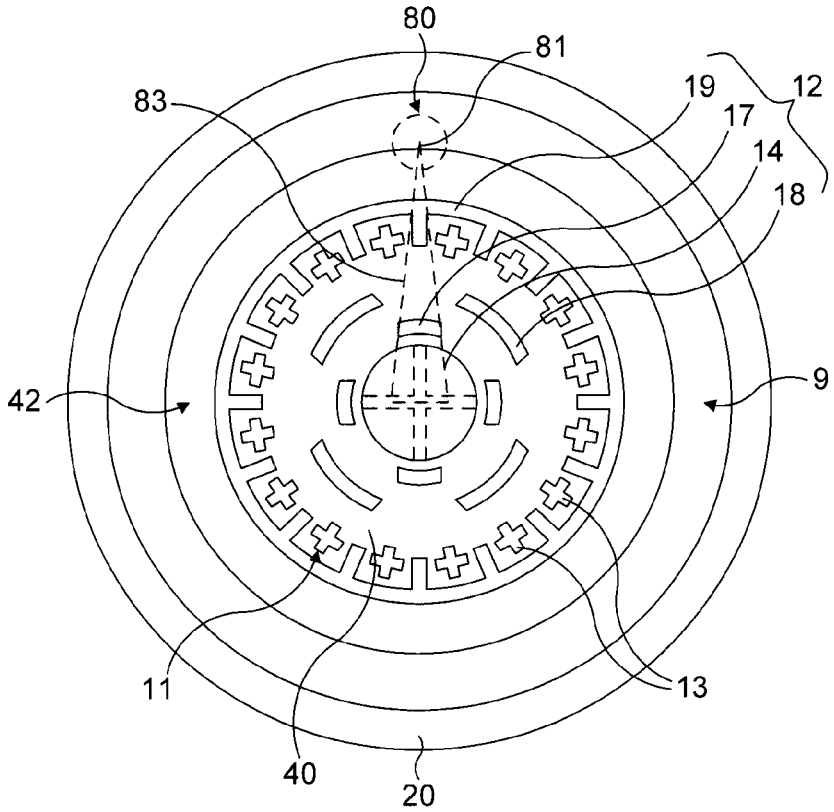
FIG. 14 is a top view of the cup of the cartridge (without its top membrane) of FIG. 2 showing the water injection device from the top.

FIGS. 13 and 14 represent a cartridge of the invention into which is introduced a water injection intruding member 80 of a beverage production device. The intruding member for the water injection 80 of the device is designed to inject water under pressure in the chamber 9 of the cartridge. Water under pressure interacts with the food substance contained in the chamber 9 to produce a food liquid that is dispensed from the cartridge. The water injection intruding member is formed like a hollow needle comprising a piercing tip 82 for piercing the lid or membrane 7 of the cartridge. The member is traversed by a water conduit leading to a water outlet 81 which is oriented in the direction of the central shield wall 14. The member can be off-centred relative to the longitudinal central axis of the cartridge and with an outlet 81 oriented towards the bottom and centre of the cartridge. More precisely, the water outlet 82 forms a water cone or jet 83 which centreline is directed to the central support surface 14. As a result, the support surface 14 forms a reflective surface for the water jet so that: firstly, the delivery membrane 8 cannot be perforated accidentally by the jet under pressure, and secondly, the reflected jets or streams of water 84 provide high turbulence in the chamber which is prone to improve the interaction between water and the substance in the chamber. In particular, an effect of vortex can be obtained in the chamber which proves to be particularly efficient for the dissolution of soluble food ingredients such as fat and/or protein based ingredients.

Figure 15:
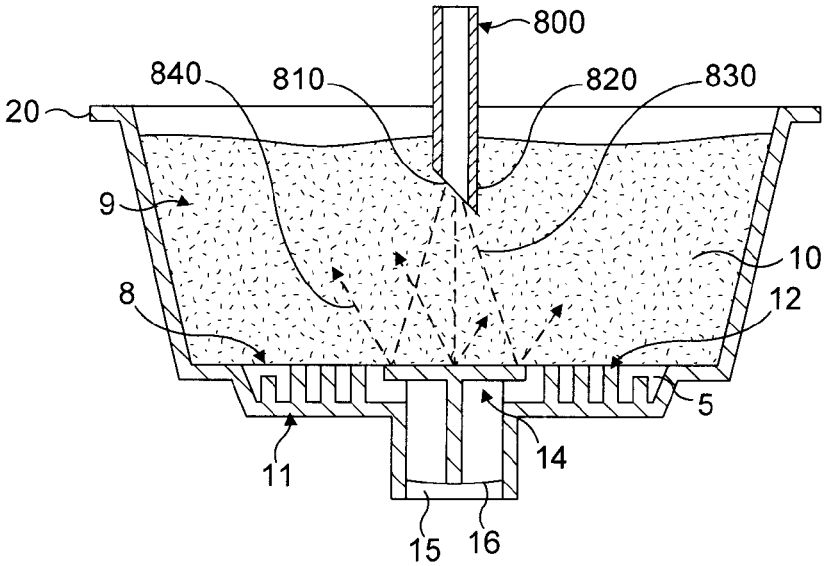
FIG. 15 is a cross sectional view of the cartridge of FIG. 2 associated to another embodiment of water injection device of a beverage preparation device.
Figure 16:
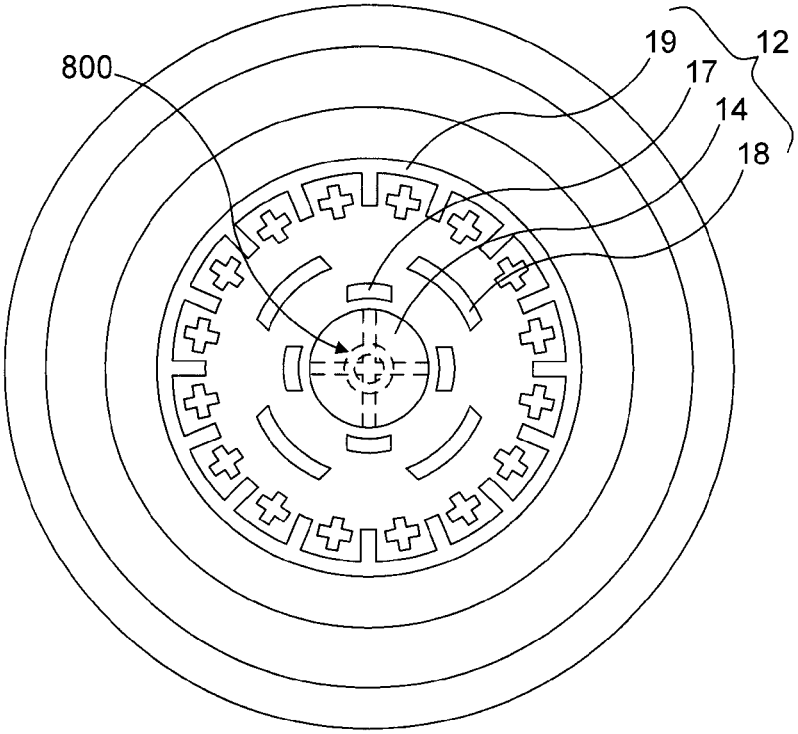
FIG. 16 is a top view of the cup of the cartridge (without its top membrane) showing the water injection device of FIG. 15 from the top.

FIGS. 15 and 16 represent a another possible configuration of the system with the water injection member 800 being centrally placed. The injection member 800 comprises a sharp tip 820 for piercing the lid and allowing the introduction of an injection part of the member in the chamber of the cartridge. The injection member 800 comprises a central needle with a straight internal water conduit ending by an outlet 810 directing the fluid in the direction of the central axis of the cartridge towards the support surface 14. Therefore, the outlet 810 is arranged in such manner that a jet of water 830 is provided under pressure from the member to the bottom of the cartridge which hits the membrane at the location of the support surface 14. Incident jets 840 are provided which create a turbulent flow of liquid in the chamber and promotes dissolution of the ingredients. There is no pressurized jet of liquid being able to flow directly through the delivery wall to the outlet 15 of the cartridge because the outlet is protected by the shield surface 14.

More than one injection member can be envisaged. The same configuration of the system is applicable to the cartridge of FIGS. 8 to 12 with the direction of the water jet(s) to the supportive surface 140.

Figure 17:
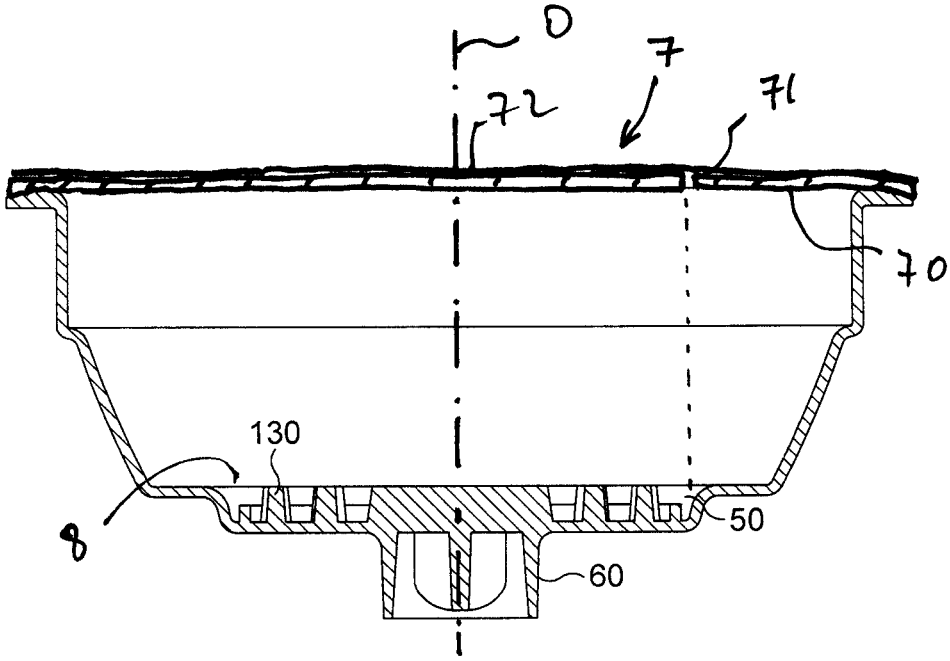
FIG. 17 is a cross sectional view of another variant of the cartridge of FIG. 8.

In the embodiment of FIG. 17, the cartridge comprises a lid 7 having a substantially rigid wall 70 sealed onto the edge of the cup. A small number of jet-forming orifices 71 are formed, preferably one or two, through the wall 70. Each orifice is preferably placed in location which is not aligned with the central axis "O" of the capsule so that a higher fluid turbulence is provided in the cartridge. The lid further comprises a protective cover 72 sealed onto the wall 70 and which can be pierceable or peelable.

Figure 18:
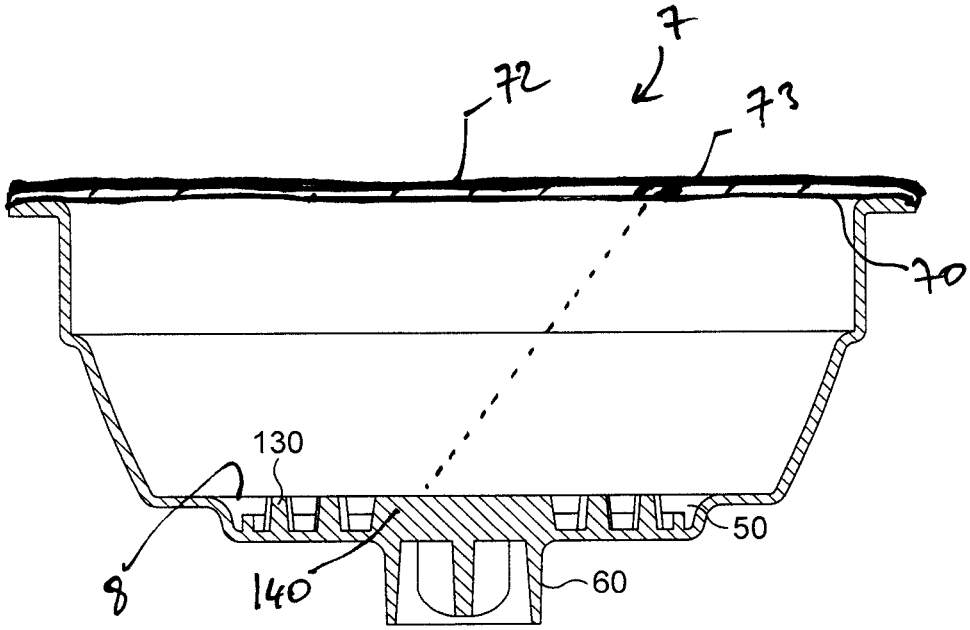
FIG. 18 is a cross sectional view of a variant of the cartridge of FIG. 8 in which the lid of the capsule comprises at least one jet-forming orifice oriented perpendicularly to the puncturable delivery wall.

In the embodiment of FIG. 18, the cartridge comprises a lid 7 having a rigid wall 70 in which a small number of orifices are created which are oriented in a direction of the support surface 140. As a result, the jet of liquid can reflect towards the interior of the cartridge without the risk of perforating the puncturable delivery wall 8. The lid may also comprise a protective cover 72.

The present invention has been described in relation to different embodiments as a matter of example. However, other examples are possible as well as combinations of the presently described examples. For example, the ingredient may be an ingredient that does not dissolve but is brewed such as tea leaves or ground coffee.

The invention claimed is:

1. A cartridge containing a food substance that interacts with water injected into the cartridge to produce a food liquid that is dispensed from the cartridge comprising:

a cup having a chamber for holding the food substance and a lid, a puncturable delivery wall that holds the substance in the chamber, a puncturing structure comprising a series of protrusions and being adapted to puncture at least one opening in the delivery wall in response to water filling the chamber, a collecting area for collecting the liquid passing through the delivery wall in a substantially axial direction, the collecting area being located downstream of the puncturable delivery wall, at least one liquid outlet in the collecting area for allowing liquid to leave the collecting area, and at least one support surface arranged in the flow path between the puncturing structure and the at least one liquid outlet, in the collecting area at a radial distance from the at least one liquid outlet for preventing the delivery wall from collapsing in the collecting area or from forming blocking areas for the flow, wherein the at least one support surface comprises (i) portions of ridges extending in a radial direction relative to a center of the collecting area and between the protrusions, and (ii) curved portions of ridges arranged in a discontinuous concentric pattern that forms radial passages therebetween.

2. The cartridge of claim 1, wherein the support surface is further positioned in the flow path at a position selected from the group consisting of above and adjacent the at least one liquid outlet.

3. The cartridge of claim 1, wherein the support structure is positioned between the puncturable delivery wall and the bottom wall of the cup forming the collecting area.

4. The cartridge of claim 3, wherein the support structure is integral with the bottom wall of the cup.

5. The cartridge of claim 1, wherein the cartridge comprises a series of outlets placed in a center of the collecting area.

6. The cartridge of claim 5, wherein at least one support surface forms a portion of a disc or a dome that extends transversally beyond the series of outlets.

7. The cartridge of claim 1, wherein the portions of ridges are located in the flow path between the puncturing structure and the outlet.

8. The cartridge of claim 7, wherein the portions of ridges are located concentrically around the liquid outlet with flow passages in-between for interrupting the flow of liquid towards the outlet.

9. The cartridge of claim 7, wherein the puncturing structure forms a plurality of small protrusions.

10. The cartridge of claim 9, wherein the protrusions are arranged concentrically around the outlet(s).

11. The cartridge of claim 9, wherein the puncture structure comprises puncture surfaces of a smaller width or section than a width or section of the support surface of the support structure.

12. The cartridge of claim 1, wherein the puncturing structure comprises a plurality of sharp puncturing forms.

13. The cartridge of claim 1, wherein the support structure comprises portions of ridges positioned in a radial direction with respect to the bottom surface of the cup.

14. The cartridge of claim 1, wherein the lid comprises at least one injection orifice of a small size for forming a jet of the liquid entering the chamber containing the food substance.

15. A cartridge system comprising:

a cartridge according to claim 1 and a beverage production device for holding the cartridge and a water injection member;

the cartridge contains a food substance adapted to interact with water injected through the water injection member into the cartridge and to produce a food liquid that is dispensed from the cartridge;

the cartridge comprises a support structure comprising at least one support surface designed to support at least one portion of the delivery wall and the water injection member being configured to inject water in the chamber under pressure in the form of at least one jet.

16. The cartridge of claim 1, wherein the support structure comprises a disc or a dome that extends transversally beyond the outlet in the same plane as the top of the puncturing structure.

17. The cartridge system of claim 15, wherein the support structure comprises a disc or a dome that extends transversally beyond the outlet in the same plane as the top of the puncturing structure.

18. The cartridge of claim 12, wherein the puncturing forms are selected from the group consisting of crosses, cones and blades.

19. The cartridge of claim 16, wherein the disc or dome is connected to the bottom surface of the collecting area by legs delimiting passages for the liquid to flow in the at least one liquid outlet.

20. The cartridge system of claim 17, wherein the disc or dome is connected to the bottom surface of the collecting area by legs delimiting passages for the liquid to flow in the at least one liquid outlet.

* * * * *